US006998950B2

(12) United States Patent
Skibinski

(10) Patent No.: US 6,998,950 B2
(45) Date of Patent: Feb. 14, 2006

(54) METHOD OF MAKING AN ELECTRIC INDUCTOR AND INDUCTOR MADE BY SAME

(75) Inventor: Gary Leonard Skibinski, Milwaukee, WI (US)

(73) Assignee: Rockwell Automation Technologies, Inc., Mayfield Heights, OH (US)

( * ) Notice: Subject to any disclaimer, the term of this patent is extended or adjusted under 35 U.S.C. 154(b) by 10 days.

(21) Appl. No.: 10/675,307

(22) Filed: Sep. 30, 2003

(65) Prior Publication Data

US 2005/0068141 A1 Mar. 31, 2005

(51) Int. Cl.
*H01F 27/08* (2006.01)

(52) U.S. Cl. ..... 336/61; 336/55

(58) Field of Classification Search ..... 336/55, 336/90, 61, 65, 96, 92, 59
See application file for complete search history.

(56) References Cited

U.S. PATENT DOCUMENTS 6,353,706 B1 * 3/2002 Bridges ..... 392/306
6,366,486 B1 * 4/2002 Chen et al. ..... 363/141
6,392,519 B1 * 5/2002 Ronning ..... 336/90
6,518,868 B1 * 2/2003 Miller et al. ..... 336/55

* cited by examiner

*Primary Examiner*—Anh Mai
(74) *Attorney, Agent, or Firm*—Patrick S. Yoder; William R. Walbrun

(57) ABSTRACT

An inductor design is disclosed which balances thermal requirements with magnetic and other requirements. The package is designed based upon the desired magnetic volume and the dimensions of a primary heat dissipation surface, which is preferably designed for conductive heat transfer during operation. The other dimensions, such as the height of the package, result from these two parameters. Optimized package designs may thus be obtained which provide the desired operating temperatures, while better utilizing the magnetic volume. Package designs may include new aspect ratios, such as ratios providing a base area greater than a lateral side area. Aspect ratios between base dimensions, such as a diameter in cylindrical package and the resulting height may also be characteristic of the inductors resulting from the novel design approach.

20 Claims, 2 Drawing Sheets

METHOD OF MAKING AN ELECTRIC INDUCTOR AND INDUCTOR MADE BY SAME

BACKGROUND OF THE INVENTION

The present invention relates generally to the field of power electrical inductors such as used in connection with power electronic and power distribution circuits. More particularly, the invention relates to a novel approach to the design and configuration of inductors to enhance their thermal transfer properties when used in conjunction with conductive or convective cooling apparatus.

In the field of power electronic devices, a wide range of circuitry is known and currently available for converting, producing and applying power to loads. Depending upon the application, such circuitry may convert incoming power from one form to another as needed by the load. In a typical arrangement, for example, constant (or varying) frequency alternating current power (such as from a utility grid or generator) is converted to controlled frequency alternating current power to drive motors, and other loads. In this type of application, the frequency of the output power can be regulated to control the speed of the motor or other device. Many other applications exist, however, for power electronic circuits which can convert alternating current power to direct current power, or vice versa, or that otherwise manipulate, filter, or modify electric signals for powering a load. Circuits of this type generally include inverters, converters, and similar switched circuitry. Other applications include universal power controllers, micro-turbine generators, universal power sources, and so forth.

Many power electronic circuits of the type mentioned above require filtration through the use of chokes or inductors used on either a line side or a load side of the circuitry, or both. Such inductors serve to limit current, shape waveforms and improve harmonics. In addition, certain circuitry may employ direct current link inductors, such as between two inverter circuits in a drive application. Common mode inductors are also employed, depending upon the system requirements.

Depending upon the system configuration, input and output power levels, frequencies, and so forth, chokes and inductors used in power electronic circuits can be quite sizeable. The physical packaging in such applications becomes problematic, both from mounting and interconnection standpoints. Furthermore, due to the inherent functionality of the inductors, large amounts of heat may be generated during operation which must be dissipated to maintain the internal temperatures of the inductor within a desired thermal operating range. In large packaged inductors, such thermal management becomes extremely problematic. For example, currently available inductors that can be scaled to power electronic circuits include packaging configurations in which a bundle of conductive wire is disposed within an encapsulated shell. A potting material, typically epoxy, is disposed within the shell to seal the structure. These structures are not, however, completely modular in design, and require termination of leads extending from the shell. While a certain amount of cooling can be provided against a face of the shell, and cooling conductors can be routed through an aperture formed in the shell, these measures are typically insufficient to develop the desired level of cooling of interior regions of the structure.

There is a need, therefore, for improved inductor assemblies that can be more easily and efficiently cooled during operation. There is a particular need for inductors that can be packaged in a modular manner and cooled by convective and/or conductive cooling media for enhanced power and magnetic densities in packaging that maintain desired temperature ranges.

SUMMARY OF THE INVENTION

The invention provides a novel approach to inductor design that responds to such needs. The approach is based upon the balancing of the electrical and magnetic requirements of inductors with the thermal transfer requirements. In general, a surface, which may be designated a base surface, of the inductor package is configured to act as a primary thermal transfer surface. Thermal transfer through this surface may be performed in various manners, but particularly through the use of liquid or fluid cooling. Such conductive and convective cooling media may include liquid-circulation cold plates, thinned heat dissipation devices, and so forth. The overall volume of the inductor is sized in accordance with the desired magnetic volume. The size and dimensions of the footprint of the primary heat dissipation surface is then determined, and the remaining dimensions of the inductor package are determined based upon these two parameters. In one embodiment, for example, a cylindrical inductor is designed that has a desired magnetic volume, and a round base having an area sufficient to dissipate heat through a cold plate to which the inductor is mounted. The height of the inductor is then determined based upon dividing the magnetic volume by the area of the base.

The invention enables a wide range of inductor configurations to be designed. Such inductors may be made in cylindrical packages, rectangular packages, and so forth, and inductor coils may be wound along vertical or horizontal axes, that is, parallel or perpendicular to the base. More than one surface may be designated for heat dissipation, although the design is based upon computation of the sidewalls of the inductor as a result of determination of the desired areas of the primary heat dissipation surface or surfaces. In use, the inductors may dissipate heat in multiple modes. That is, the base may dissipate heat in a conductive or conductive/convective mode, while the sidewalls may dissipate heat in a convective mode only.

The novel approach to inductor design provides a number of benefits as compared to previous designs. For example, the resulting aspect ratio is substantially altered. The resulting structures will typically have base areas which are greater than the areas of the one or more sidewalls. The approach also results in a lower overall internal temperature and a migration of the "hot spot" or point of maximum temperature in the inductor package, toward the primary heat dissipation surface. The resulting thermal gradients within the inductor package allow for the reduced overall temperature, and can permit greater loads in a more electrically and magnetically dense device, while respecting target operating temperatures.

BRIEF DESCRIPTION OF THE DRAWINGS

The foregoing and other advantages and features of the invention will become apparent upon reading the following detailed description and upon reference to the drawings in which.

DETAILED DESCRIPTION OF SPECIFIC EMBODIMENTS

Figure 1:
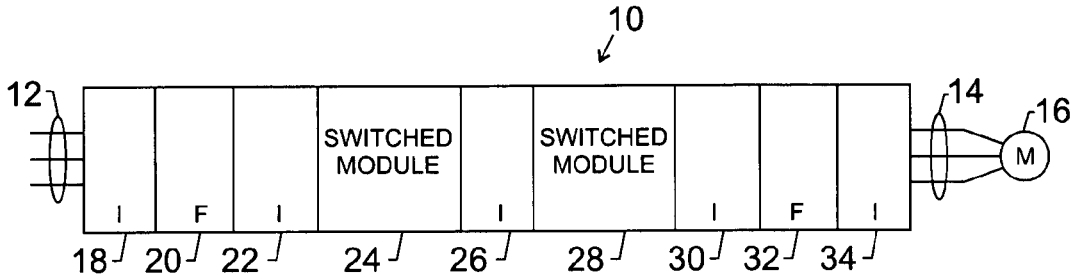
FIG. 1 is a diagrammatical representation of an exemplary power electronic circuit in which several inductors are incorporated which may be configured in accordance with aspects of the present technique.

Turning now to the drawings, and referring first to FIG. 1, a power converter circuit 10 is illustrated and designated generally by reference numeral 10. In the illustrated embodiment, circuit 10 receives input power, such as via three-phase conductors 12, and produces output power as illustrated at reference numeral 14 for application to a load, such as a motor 16. While reference is made in the present description to a power converter circuit generally, and including specific components, aspects of the present technique relating to configuration of improved inductors, incorporation of such components into systems, and overall system design can be employed in a wide range of circuits and settings. Thus, the present techniques apply equally well to universal power controllers, frequency controllers, micro-turbine generator applications, universal power sources, inverter circuits, matrix converters, by-directional and uni-directional power supplies, and so forth. In certain embodiments, such as that illustrated in FIG. 1, for example, the circuits are designed for receiving power from a grid or utility and applying power to a load. However, in other settings, power may be received from various AC sources, such as micro-turbines, generators and the like, or power may be received in DC form.

Referring again to FIG. 1, the circuit 10 is illustrated as including a first modular inductor 18, a filter 20, a second modular inductor 22, and a switched module 24. In an exemplary embodiment, the switched module may include any suitable components, such as an inverter array of IGBT's and fly-back diodes for converting the incoming AC waveform to DC power. Again in the illustrated embodiment, a further inductor assembly 26 may include DC link inductors, particularly where the circuit arrangement is used as a drive. A further switched module 28 converts the power to an output waveform of desired frequency, and applies the power to a further series of an inductor 30, filter 32, and inductor 34.

As will be appreciated by those skilled in the art, the various components illustrated diagrammatically in FIG. 1 may be included, or may not be necessary in all applications. The inductors 18 and 22, for example, serve to condition incoming power, as does the filter circuit 20 (e.g. a sine wave filter tuned to a filtering frequency permitting reduction in the size of the inductors).

It has been found that limitations in reduction in size and further integration of modular components of the type illustrated in FIG. 1 arise due to problems and extracting heat from the components during operation. In particular, where relatively large inductors are incorporated into such systems, currents applied to the inductors can generate substantial thermal energy which, by the present technique, can be efficiently removed from the components, permitting improved performance and more compact packaging.

Inductors 18, 22, 26, 30 and 34 illustrated in FIG. 1 may be formed in accordance with the present technique for enhanced heat dissipation. As will be appreciated by those skilled in the art, depending upon the inductor design, significant heat may be generated during periods of operation, which can limit the operation of the inductor, and even result in degradation or even failure of the inductor over time. Conventional approaches to reducing heat in such packaged inductors have included convective heat transfer through sidewalls, mounting of the inductors on heat dissipation surfaces, circulation of fluid through the inductors, and so forth. However, no heretofore known technique has addressed the balance of the inductive package with the heat dissipation requirements, placing these latter requirements foremost in the dimensional relationships of the inductor design. Accordingly, one or more of the inductors mentioned above is preferably formed in accordance with the present technique, in circuits such as that shown in FIG. 1, or in any other suitable setting, application or circuitry.

Figure 2:
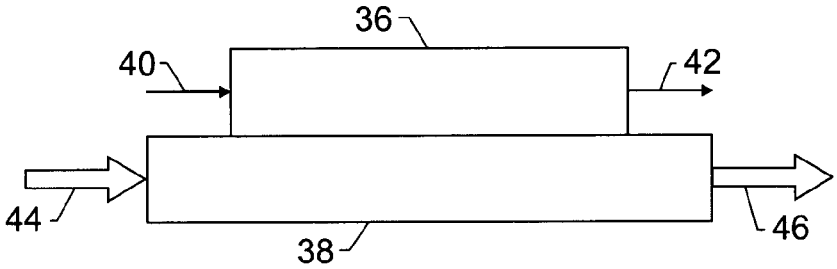
FIG. 2 is a diagrammatical elevational view of a modular inductor in accordance with the present technique shown mounted to a heat dissipation device, such as a liquid-cooled cold plate.

FIG. 2 illustrates an inductor package 36 which may be any one of or a inductor different from the inductors mentioned above. The inductor package 36 may take any suitable shape, such as a cylindrical shape, a box or parallelepipedic shape, or any modular or integrated package configuration. In the diagrammatical representation of FIG. 3, the inductor package 36 is shown mounted on a heat dissipation device 38, such as a cold plate. The inductor receives power input as illustrated by arrow 40, and outputs power as illustrated by arrow 42. In doing so, significant heat may be generated in the inductor package which must be dissipated to maintain a steady state internal temperature of the package at a design level. The heat dissipation device 38 may generally receive a coolant as indicated at reference numeral 44, and output a coolant as indicated at arrow 46. It should be borne in mind that, while in a presently contemplated embodiment, heat dissipation device 38 is a liquid-cooled cold plate, other heat dissipation devices can be used in conjunction with the improved inductor, such as extruded finned subplates, forced and natural convention mounted surface, air-cooled bases and cold plates, and so forth. While the mode of heat transfer through the base, as discussed in greater detail below may be complex, in a presently contemplated implementation, the base of the inductor package conducts to the heat dissipation device 38 via conduction as a first or principle mechanism, with convective heat transfer from the heat dissipation device 38 being a secondary mode, which may include forced convection via liquid or gaseous media.

Figure 3:
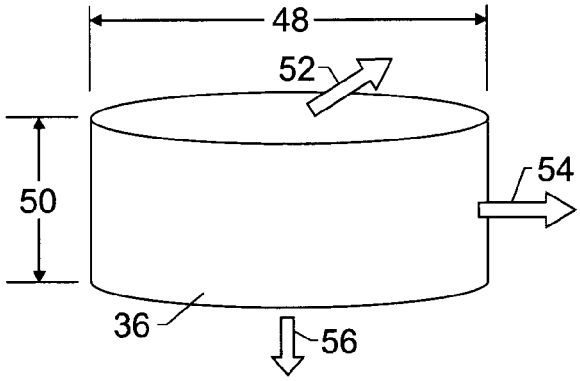
FIG. 3 is a diagrammatical representation of an inductor package, a cylindrical package in the illustrated figure, for discussion of the dimensional relationships of the package in accordance with aspects of the present technique for enhanced heat dissipation through the base.

As illustrated in FIG. 3, the inductor package 36 has dimensions which are selected in accordance with criteria that optimize both the magnetic properties of the inductor and its thermal management properties. That is, as will be appreciated by those skilled in the art, the inductor will generally be designed to exhibit desired electrical and magnetic properties. An inductor coils within the package will perform the inductive functions in conjunctions with magnetic coupling to the inductor package itself. In general, the inductor will have the desired magnetic volume which may be computed as the volume of the overall package or shell, that is, its outer dimensions. In the illustration of FIG. 3, for the cylindrical package shown, these dimensions will simply be the area of the base of the cylinder times its height. The base of the right cylinder as illustrated in FIG. 3 may be computed from its diameter 48. The magnetic volume may then be computed by multiplying this base area times height 50 of the inductor package. Based upon this desired magnetic volume, then, and the desired dimension of the base for dissipation to the heat dissipation device, the height 50 may be computed. That is, the present technique bases the package design upon two principle factors. These include the desired magnetic volume and the desired dimensions or area of the primary heat dissipation surface. In the present discussion, the primary dissipation surface is conveniently selected as the base or bottom of the inductor package. Clearly, other surfaces may be designated as the primary heat dissipation surface, simply depending upon the orientation of the package. That is, the top surface in the views illustrated may serve as the primary heat dissipation surface, or multiple surfaces, such as the top and bottom surfaces may serve this function (i.e. with heat dissipation devices coupled to both surfaces for conductive heat transfer). Similarly, many alternative package designs may be envisaged, such as square or rectangular designs, multi-sided designs, and so forth. The right cylindrical design shown and discussed herein is provided by way of example only.

In the diagrammatical view of FIG. 3, the various surfaces are shown to dissipate heat as indicated by arrows 52, 54 and 56. That is, where the package 36 is mounted to a heat dissipation device 38 as shown in FIG. 2, conductive heat transfer will occur between the base of the package and the heat dissipation device. Heat transfer from the upper surface of the package, as indicated by reference numeral 52, will be principally via conductive and radiative modes. Similarly, heat transfer from the sides of the package, as indicated by arrow 54, will be via convective and radiative modes. However, the principle mode of heat transfer from the base, as indicated by reference numeral 56 will be conductive, at least to the heat dissipation device 38 as shown in FIG. 2.

Thus, the principle considerations for the design of the inductor package in accordance with the present technique are magnetic volume and the desired area of the primary dissipation surface. These factors, of course, are taken into account once the electrical properties of the inductor are settled, including the number of turns of conductive wire or foil, any dielectric properties, the configuration of normal mode and common mode conductors, and so forth. Those skilled in the art will readily appreciate the factors involved in the design of the conductor and dielectric elements of the inductor.

Figure 4:
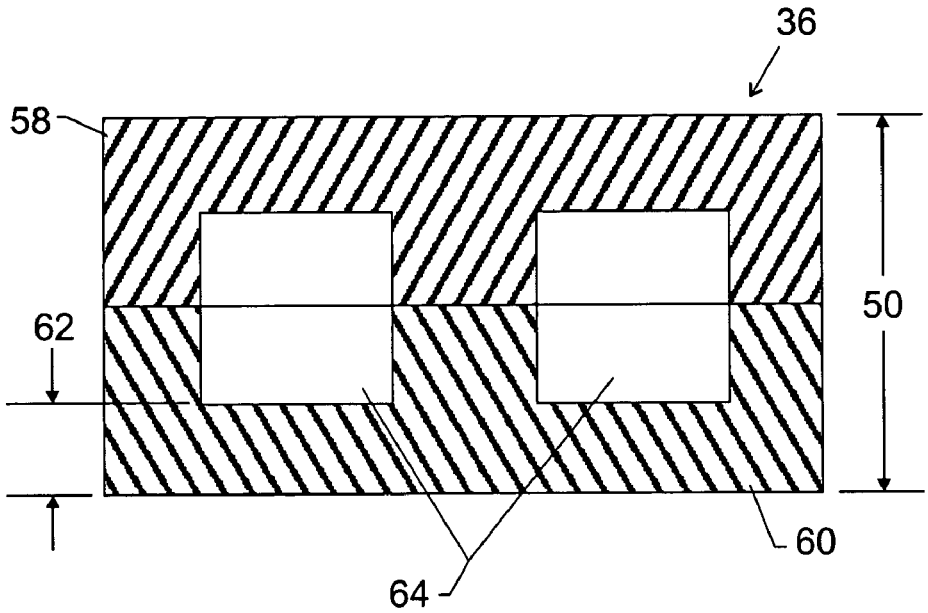
FIG. 4 is a sectional view of an exemplary inductor shell illustrating certain of the dimensions of the package and considerations of the overall package design.

Continuing with the present discussion of the inductor packaging, FIG. 4 illustrates an exemplary sectional view of an inductor package in accordance with the present technique. As shown in FIG. 4, upper and lower shells 58 and 60 may be joined to provide the package 36 having the desired dimensions. The two shells may be self-similar, such that they define not only the outer surface, but any internal features, such as a central post around which the inductor coil of coils are installed. Sidewalls of the shells may be designed to have thicknesses, as indicated at reference numeral 62, that respect both the desired magnetic properties and any mechanical considerations, such as the mechanical integrity and strength of the materials, the magnetic and electrical properties, and so forth. In general, however, the shells are configured to provide the desired magnetic volume and to have the dimensions desired for heat dissipation. One or more internal cavities 64 are thus designed to receive the inductor coil or coils, as well as any instrumentation, sensors, potting material, and so forth required for the final packaged unit.

Figure 5:
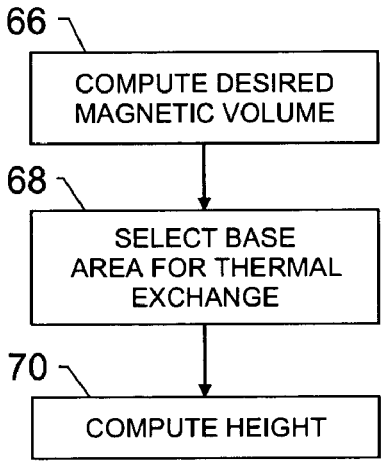
FIG. 5 is a flow chart illustrating the principle steps in the logic for the design of the improved inductor of the present technique.

As mentioned above, the inductor approach of the present technique is based upon the magnetic volume of the package and upon the base or primary heat dissipation surface area. The logical steps involved in this design and selection process are summarized in FIG. 5. In the first step, the desired magnetic volume is computed as indicated at reference numeral 66. As opposed to heretofore known techniques, in which volumes were selected in accordance with sidewall height required for convective heat transfer, the present technique begins with computation of the desired magnetic volume, based upon the operating parameters of the inductor from electrical and magnetic standpoints. At step 68, the desired base area is selected. In general, the base area is based upon the desired target operating temperatures of the inductor, the temperatures of available cooling media (providing a temperature of differential for heat extraction), and the area required to obtain optimal heat transfer and migration of the hottest point of the inductor to a desired level of the package. As noted above, where the base of the inductor is the primary heat dissipation surface, this base area will be used. Where multiple areas are subjected to conductive heat transfer modes, multiple such areas may be used, such as a bottom and top surface. Based upon these dimensions, then, the height or other dimensions of the package may be computed. In its simplest form, the design and selection logic provide for determining a magnetic volume, determining a surface area of a regular solid, and simply calculating the height by dividing the volume by the base area. Other dimensions may, of course, be utilized, depending upon the general configuration of the package.

By way of example, a right cylindrical inductor package was designed which can be based upon the beginning dimensions of commercially available inductor packages.

TABLE 1 illustrates exemplary dimensions of such a package as compared to inductor designs made in accordance with the present technique.

| Mag Vol ($cm^3$) | d (cm) | Base Area ($cm^2$) | h (cm) | Side Area ($cm^2$) |
|---|---|---|---|---|
| 1800 | 12 | 113 | 15.9 | 600 |
| 1800 | 17.5 | 240 | 7.5 | 412 |
| 1800 | 23 | 415 | 4.3 | 310 |

As shown in Table 1, a desired overall magnetic volume is computed for the package, which, in the example, is approximately 1,800 $cm^3$. This is a selected based upon a commercially available package inductor having a right cylindrical configuration with a diameter of 12 cm in a height of 16 cm. From rounding in the example, however, beginning with the magnetic volume and computing the base area to be approximately 113 $cm^2$, the resulting height is approximately 15.9 cm. The resulting side area is, then, approximately 600 $cm^2$, the side area comprising, in the computation, only the lateral sides, and not the tope area. It has been found that such packages are not optimized in that, although the magnetic volume may permit a certain load or power density, the dimensions of the package do not provide for sufficient heat dissipation through the sidewalls or movement of the points of highest temperature sufficiently towards the base for heat dissipation. That is, the package design is not balanced, but is limited by the thermal characteristics (i.e. the inability to sufficiently dissipate heat through the side area, top area and base area). This is true even when such inductor packages are mounted on liquid-cooled cold plates.

Following the examples summarized in Table 1, in a first alternative, a base area of approximately 240 $cm^2$ is selected, which results in a diameter of the right cylindrical package of approximately 17.5 cm, resulting in a side area of only approximately 412 $cm^2$. Such package designs effectively provide greater base areas for heat dissipation via conductive modes, and thereby migrate the hot spots of the inductor package downwardly toward the base. By further refinement, the third example summarized in Table 1 includes a base area of approximately 415 $cm^2$, which implies a diameter of approximately 23 cm. Based upon the magnetic volume and the base area, then, the package has a height of only 4.3 cm. At this point, the base area is actually greater than the area of the lateral sides, which can be computed to become approximately 310 $cm^2$.

Depending upon the efficiency of heat transfer, and particularly upon the thermal characteristics of the materials used for extraction of a heat from the package, and the temperatures of the cooling media available, a balance is thus struck between the electrical and magnetic properties of the inductor and the thermal properties. An aspect ration may be thus maintained which, as apposed to prior techniques, is based upon thermal conduction through a primary heat dissipation surface, such as the base of the package. It is anticipated that aspect ratios may be favored in which base areas are greater than lateral side areas of the resulting packages. It is also anticipated that inductors designed in accordance with the present techniques may have characteristic relationships between the base dimensions and the height. For example, for right cylindrical inductors, the present technique may generally result in inductors having heights which are less than 40% of the base diameter. As illustrated in Table 1. However, the present technique may also provide package dimensions in which the height is less than 30% or even 20% of the base diameter. Ultimately, it is anticipated that the limitations or constraints upon the package design may be those of the internal dimensions that should be maintained for accommodating the inductor coil or coils (see cavities 64 in FIG. 4), and the required material dimensions for the shell of the package (see the dimension 62 in FIG. 4). In all of these package designs, however, the present technique provides for optimization of the package such that the package is no longer limited by the thermal characteristics of the package, but provides optimal cooling for the electrical, magnetic, and mechanical design constraints.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

What is claimed is:

1. A method for making an electrical inductor, the method comprising:

determining a desired magnetic volume of the inductor;

determining a desired area of a primary heat dissipation surface; and determining remaining dimensions of the inductor based upon the magnetic volume and the primary heat dissipation surface area, such that the inductor has a height less than 40 percent of the diameter of the base surface.

2. The method of claim 1, wherein the inductor has a cylindrical configuration, and the primary heat dissipation surface is a base surface having a predetermined diameter.

3. An electrical inductor made in accordance with the method of claim 1.

4. The method of claim l wherein the inductor has a height less than 30 percent of the diameter of the base surface.

5. The method of claim 4, wherein the inductor has a height less than 20 percent of the diameter of the base surface.

6. The method of claim 5, wherein the primary heat dissipation surface is a base surface of the inductor.

7. The method of claim 1, wherein the primary heat dissipation surface is configured to dissipate heat from the inductor via a conductive heat transfer mode.

8. The method of claim 1, wherein the remaining dimensions of the inductor include a height dimension.

9. The method of claim 1, wherein remaining dimensions of the inductor are determined such that lateral side surfaces have a collective area less than the desired area of the primary heat dissipation surface.

10. An electrical inductor comprising:

a predetermined magnetic volume;

a primary heat dissipation surface having a desired surface area configured to transfer heat from the inductor in a conductive mode of heat transfer; and at least one lateral side surface configured to transfer heat in a convective mode of heat transfer, all side surfaces having a collective area less than the desired area of the primary heat dissipation surface, and wherein the height is less than 40 percent of the diameter.

11. The electrical inductor of claim 10, wherein the height is less than 30 percent of the diameter.

12. The electrical inductor of claim 11, wherein the height is less than 20 percent of the diameter.

13. An electrical inductor comprising:

a predetermined magnetic volume;

a primary heat dissipation surface having a desired surface area configured to transfer heat from the inductor in a conductive mode of heat transfer; and at least one lateral side surface configured to transfer heat in a convective mode of heat transfer, all side surfaces having a collective area less than the desired area of the primary heat dissipation surface;

wherein the primary heat dissipation surface is round and has a desired diameter, and the lateral side surface is a cylinder having a height computed by dividing the magnetic volume by the area of the primary heat dissipation surface.

14. The electrical inductor of claim 13, wherein the height is less than 40 percent of the diameter.

15. The electrical inductor of claim 14, wherein the height is less than 30 percent of the diameter.

16. The electrical inductor of claim 15, wherein the height is less than 20 percent of the diameter.

17. An electrical inductor comprising:

a predetermined magnetic volume;

a primary heat dissipation surface having a desired surface area configured to transfer heat from the inductor in a conductive mode of heat transfer; and at least one lateral side surface configured to transfer heat in a convective mode of heat transfer, all side surfaces having a collective area less than the desired area of the primary heat dissipation surface;

wherein the primary heat dissipation surface is round and has a desired diameter, and the lateral side surface is a cylinder having a height computed by dividing the magnetic volume by the area of the primary heat dissipation surface, and wherein the height is less than 40 percent of the diameter.

18. The electrical inductor of claim 17, wherein the height is less than 30 percent of the diameter.

19. The electrical inductor of claim 18, wherein the height is less than 20 percent of the diameter.

20. An electrical inductor comprising:

a predetermined magnetic volume;

a primary heat dissipation surface having a desired surface area configured to transfer heat from the inductor in a conductive mode of heat transfer; and at least one lateral side surface configured to transfer heat in a convective mode of heat transfer, all side surfaces having a collective area less than 1.6 times the desired area of the primary heat dissipation surface.

* * * * *